US011708963B1

(12) United States Patent
Glazer et al.

(10) Patent No.: US 11,708,963 B1
(45) Date of Patent: Jul. 25, 2023

(54) LIGHT FIXTURE WITH MOUNTING LEDGE

(71) Applicant: Inter-Global, Inc., St. Louis, MO (US)

(72) Inventors: Larry J. Glazer, St. Louis, MO (US); Wendell S. Dodson, St. Louis, MO (US)

(73) Assignee: Inter-Global, Inc.

( * ) Notice: Subject to any disclaimer, the term of this patent is extended or adjusted under 35 U.S.C. 154(b) by 0 days.

(21) Appl. No.: 17/718,549

(22) Filed: Apr. 12, 2022

(51) Int. Cl.

| | |
|---|---|
| ***F21V 17/10*** | (2006.01) |
| ***F21V 15/01*** | (2006.01) |
| ***F21V 23/04*** | (2006.01) |
| ***F21V 29/70*** | (2015.01) |
| ***F21V 5/04*** | (2006.01) |
| ***F21V 17/12*** | (2006.01) |
| ***F21S 8/00*** | (2006.01) |
| ***F21V 21/02*** | (2006.01) |
| ***F21Y 115/10*** | (2016.01) |

(52) U.S. Cl.
CPC ..... *F21V 17/104* (2013.01); *F21S 8/033* (2013.01); *F21S 8/036* (2013.01); *F21V 5/043* (2013.01); *F21V 5/048* (2013.01); *F21V 15/01* (2013.01); *F21V 17/12* (2013.01); *F21V 21/02* (2013.01); *F21V 23/0464* (2013.01); *F21V 23/0471* (2013.01); *F21V 29/70* (2015.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 5,309,334 A | | 5/1994 | Willison | |
| 5,722,208 A | * | 3/1998 | Humphrey | H02G 3/14 52/220.8 |
| 5,775,032 A | * | 7/1998 | Lacy | F21V 21/02 362/147 |
| 9,322,533 B1 | | 4/2016 | Pearson et al. | |
| 9,726,338 B1 | * | 8/2017 | Fu | F21S 8/036 |

(Continued)

FOREIGN PATENT DOCUMENTS

GB 2509797 A * 7/2014 ..... F21S 8/03

OTHER PUBLICATIONS

Sunset Lighting F9927-31-2-4K Wall Fixture [online]. LightingandSupplies.com, Apr. 8, 2022. Retrieved from the Internet: <URL:https://lightingandsupplies.com/sunset-lighting-f9927-31-2-4k-wall-fixture-integrated-led-glass-frosted/>.

(Continued)

*Primary Examiner* — Alan B Cariaso
(74) *Attorney, Agent, or Firm* — Creativenture Law, LLC; Dennis J M Donahue, III; Kevin Staed

(57) ABSTRACT

The light fixture connects a separable cage to a that may directly mount to the wall of a structure or which may mount to the structure through a wall plate. The cage has a frame with a roof and an open rear side that receives the backplate. A lighting assembly is connected to the front face of the backplate and is thereby housed within the interior of the cage when the unit is assembled and which can be accessed when the cage is removed. To removably attach the cage to the backplate, an aperture is provided within a ledge in the backplate that receives a tab to suspend the cage from the backplate fixedly connected to the supporting structure. Thus, the lighting assembly can be accessed by separating the cage from the backplate.

22 Claims, 10 Drawing Sheets

(56) References Cited

U.S. PATENT DOCUMENTS

| | | | | |
|---|---|---|---|---|
| 10,264,654 | B2 * | 4/2019 | Chen | F21S 8/036 |
| 10,887,958 | B1 * | 1/2021 | Fu | G08B 3/00 |
| 2020/0386388 | A1 * | 12/2020 | Dyck | E04H 4/1245 |
| 2021/0131650 | A1 * | 5/2021 | Crawford | F21V 17/18 |
| 2021/0332959 | A1 * | 10/2021 | Li | F21V 17/16 |

OTHER PUBLICATIONS

Luminance One Light Lantern F7976-31 [online]. Luminance Brands, Apr. 8, 2022. Retrieved from the Internet: <URL: https://www.luminancebrands.com/outdoor/f7976-31.html>.

* cited by examiner

Section A-A

LIGHT FIXTURE WITH MOUNTING LEDGE

CROSS-REFERENCE TO RELATED APPLICATIONS

This application is an original US Non-Provisional Patent Application and makes no claim to an earlier filing date.

STATEMENT REGARDING FEDERALLY SPONSORED RESEARCH

Not Applicable.

APPENDIX

Not Applicable.

BACKGROUND OF THE INVENTION

Field of the Invention

The present invention generally relates to the field of light fixtures, and more particularly to wall mounted sconces.

Related Art

Wall sconce type light fixtures have long been used on the interior and exterior of buildings, homes and other structures as décor and to illuminate surrounding areas. Generally, these wall-mounted light fixtures attach to a supporting structure with wires used to power the light fixture routed from the electrical system of the structure, through the backside of the fixture to the lighting assembly held within, such as a socket assembly or LED assembly. To connect the fixture to the supporting structure, a wall plate fixedly connects to the supporting structure and the fixture is releasably attached to the wall plate. In most sconce designs, it is a desire to allow a portion of the fixture to detach and provide access to the lighting assembly housed within. Accordingly, there remains a desire to those in the art to provide an improved sconce type light fixture that allows for easier assembly and disassembly.

An example of a sconce type light fixture in the prior art includes the Tempo Industries LLC light fixture described in U.S. Pat. No. 9,322,533. The fixture in the '533 Patent includes hooks that hang over side tabs in a wall plate. In a similar fashion, the wall mount portion of the light fixture by Willison, described in U.S. Pat. No. 5,309,334, includes a cover plate that interlocks with a wall plate by means of a channel configuration on the top of the fixture in addition to a bottom screw. Although both designs are satisfactory, there remains a desire for an improved fixture which can be more efficiently mounted to a supporting structuring and can accommodate differing lighting elements, such as a bulb or LED board, without necessarily changing the principal of operation of the fixture and how it is connected to the supporting structure.

SUMMARY OF THE INVENTION

The invention described herein is a light fixture housing a lighting assembly with a backplate that fixedly connects the supporting structure or via a mounting plate with a fastener and a cage that is releasably connected to the backplate. A bottom locking screw is preferably provided to lock the bottom edge of the cage to the bottom edge of the plate but the cage and backplate are otherwise connected by a tab that is releasably received within an aperture. Thus, the fixture does not require additional fasteners to connect the cage to the backplate wherein the tab and aperture can be integrated into the respective subparts as described herein.

In one aspect of the light fixture, the cage includes a roof and a frame with an open rear side. To assemble the fixture, the backplate is received within the open rear side and connected to the roof. In one embodiment, a tab is integrated into the underside of the roof and is received within an aperture in a ledge proximate to the top end of the backplate. Alternatively, an upwardly protruding tab may be connected to the front face of the backplate and received within an aperture in the roof.

In another aspect of the light fixture described herein, the downwardly protruding tab in the bottom surface of the roof may be combined with the upwardly protruding tab attached to the front face of the backplate such that multiple tabs extending in opposite directions are used to connect the cage to the backplate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figures 1A, 1B:
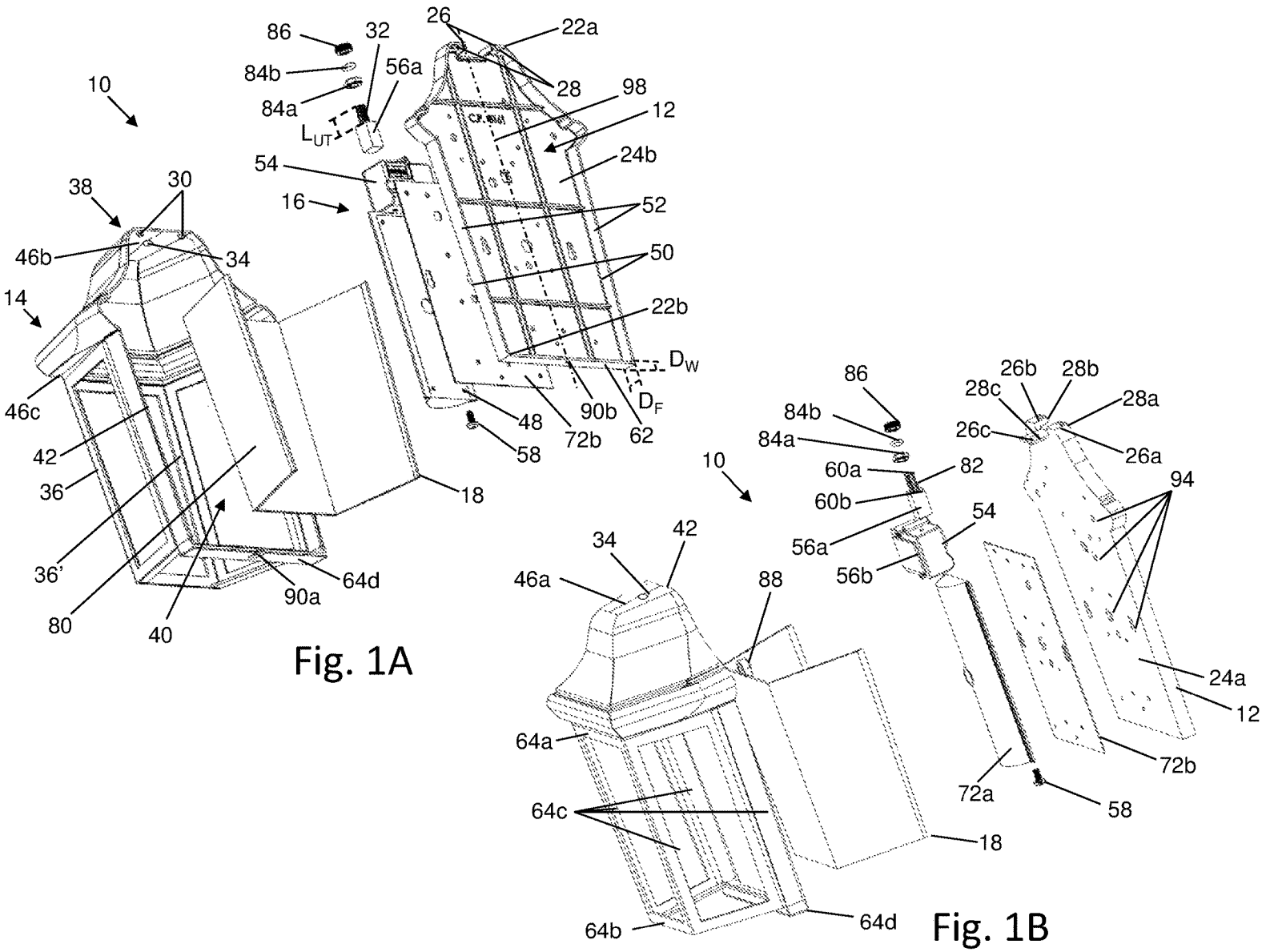
FIGS. 1A and 1B are exploded views of a light fixture according to the invention described herein.

The following description of the preferred embodiment(s) is merely exemplary in nature and is in no way intended to limit the invention, its application, or uses.

The light fixture 10 includes a backplate 12 that may directly mount to the wall of a structure or which may mount to the structure through a wall plate. The fixture also includes a cage 14 having a frame 36 with a roof 38 and an open rear side 40 that receives the backplate. A lighting assembly 16 is connected to the front face of the backplate and is thereby housed within the interior of the cage when the unit is assembled. Various lighting assemblies may attach to the front face of the backplate with the corresponding wiring extending through apertures in the backplate and into the interior of the cage. Thus, the lighting assembly can be accessed by separating the cage from the backplate.

Figure 3B:
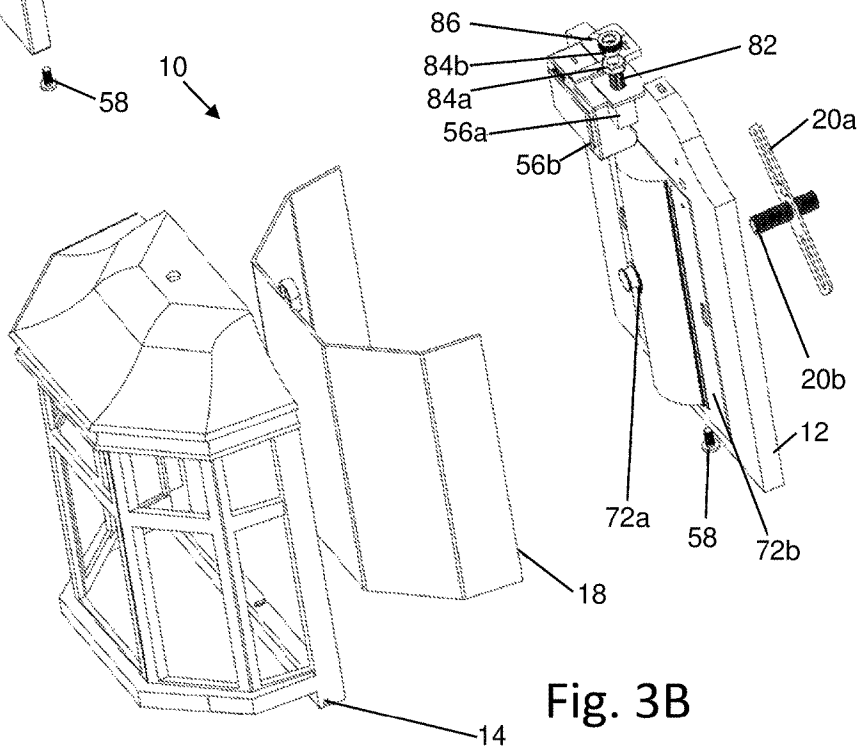
FIGS. 3A and 3B show exploded views of alternative light fixtures according to the invention described herein.

To connect the fixture to the supporting structure, the backplate connects either directly to the supporting structure, or to a mounting plate, on its rear face 24*b* with a mounting assembly 20 which may be limited to a single fastener, such as a screw extending through one of the apertures in the backplate and into the supporting structure, or a threaded nipple 20*b* which is received into a cross bar 20*a* as shown in FIG. 3B. The front face 24*a* of the backplate faces away from the supporting structure and a series of apertures 94 are provided within the backplate to allow various lighting assemblies to be connected thereto and to allow electrical wiring to pass from the supporting structure to the lighting assembly connected to the front face. The backplate is substantially planar with a longitudinal axis 98 between a top end 22*a* and bottom end 22*b* and a perimeter shape that mirrors the rear opening of the cage.

Figure 6A:
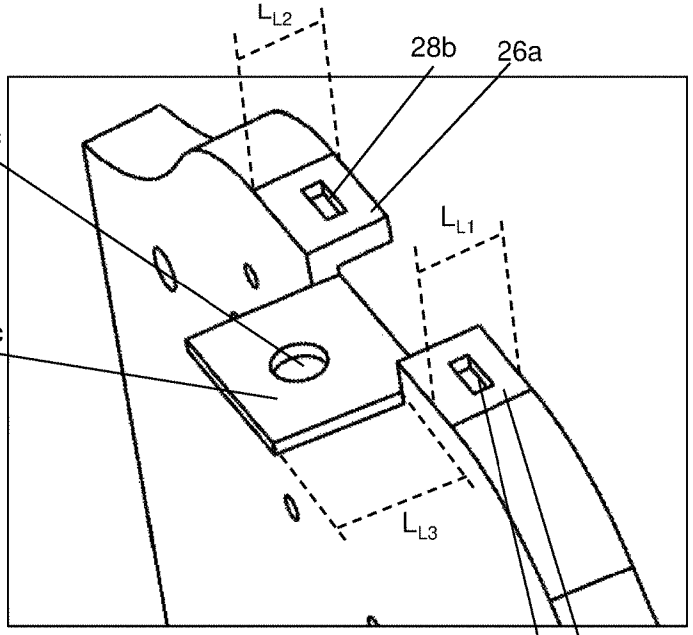
FIGS. 6A and 6B each show detail views of alternative light fixture ledge configurations according to the invention described herein.
Figure 6B:
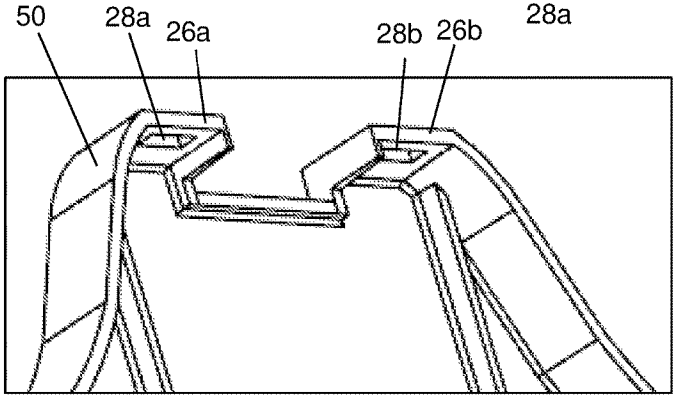

At least one ledge 26 with a ledge aperture 28 is provided proximate to the top end of the backplate and protrudes a ledge length from the backplate in a direction that is substantially perpendicular to the longitudinal axis of the backplate. In the preferred embodiment, a first ledge 26*a* and second ledge 26*b* rearwardly extend a ledge length (41, 42) along the top end of the backplate, extending and a third forward extending ledge 26*c* protrudes a third ledge length (43) from the front face of the backplate. As further explained below, a tab is subsequently received in each ledge aperture 28*a*, 28*b* and 28*c* and the cage and backplate are thereby releasably connected in an assembled configuration 44. Although the preferred embodiment shown in the drawings includes both a pair of rear ledges and a front ledge, it will be appreciated that a single rear ledge may be provided without departing from the invention described herein. Similarly, multiple forward ledges may also be integrated into the light fixture described herein. In the preferred embodiments shown in FIGS. 6A and 6B, there are a pair of rear ledges. Preferably, the forward-facing ledge is longer than the rearward-facing ledges.

The cage includes a frame covered by a roof with each having a rear perimeter edge 42 that surrounds an open rear side for receiving the backplate. The frame has an upper collar 64*a* that is attached to the periphery of the roof and a lower collar 64*b* beneath the upper collar. To connect the upper collar to the lower collar, side rails 64*c* extend therebetween and hold a lens 18 around the light assembly housed within the cage. The frame may also include a lower rear rail 64*d* which is secured to the bottom end of the backplate with a locking screw as explained below.

To secure the cage to the backplate with the locking screw 58, a bottom flange 62 is provided along the bottom end of the backplate and an aperture 90*b* within the flange aligns with a locking aperture 90*a* in the lower rear rail the frame. A user can then screw the locking screw into the aligned apertures when the cage and backplate are assembled to more securely lock the cage and backplate together 66. Although the flange in the preferred embodiment that is shown in the drawings protrudes rearward of the backplate, alternative embodiments may incorporate a flange that is forward of the backplate. In addition to the bottom flange extending from the bottom end of the backplate, sidewalls 52 may also extend from the corresponding side ends 50 of the backplate with the distance of the sidewalls ($D_W$) and the bottom flange ($D_F$) being equal to the length of the ledge extending from the rear face of the backplate.

The lens held within the cage is preferably formed into a shape 78 from an acrylic thermoplastic material as a single-piece, thin-walled shell. As shown in FIGS. 1-4, the lens can be formed in a prismatic shape which corresponds to the polygonal geometries of the cage and roof in the light fixture. Alternatively, the cage can have a different shape, such as a cylindrical shape or triangular shape, and the lens will be shaped to match the geometries of the cage. Generally, the lens is positioned at a distance (DL) around the light assembly with the outer surface of the lens 80 contacting the interior of the frame 36'. A lens mounting aperture 88 may also be provided to secure the lens to the frame. In the preferred embodiment there are at least one front side rail 76*a* and a pair of rear side rails 76*b* for supporting the lens. However, in some light fixture configurations the lens can replace the side rails and connect the upper collar and lower collar without the side rails. It will be appreciated that the lens can be made with various plastic materials or glass and can be transparent or translucent.

The roof of the frame includes a top side 46*a*, bottom side 46*b* and periphery 46*c* along with the rear edge that forms the top edge of the rear opening of the frame. The periphery of the roof engages with the upper collar of the frame and is preferably molded therewith in a single unitary cage piece. Alternatively, the frame and roof may be separately formed and attached during manufacturing. The roof is a solid panel with the periphery having an identical geometry to the upper collar of the frame and although the roof is substantially planar in the preferred embodiment, it may be pitched or curved and is not necessarily flat.

In the preferred embodiment, a roof aperture 34 is offset from the rear edge of the roof for receiving an upwardly protruding tab 32 as further explained below. In addition, a downwardly protruding tab functions as a cage support tab 30 and protrudes a tab length ($L_{LT}$) from the bottom side of the roof. The downwardly protruding cage support tab is subsequently received within a corresponding ledge aperture and the cage is hung from the backplate. The dimensions of the corresponding downward tab, ledge and aperture therein are not intended to be limiting and instead will be sized relative to one another such that the tab will reach the aperture and be received therein when the unit is assembled. Accordingly, when the ledge is spaced from the top end of the backplate, the tab will be longer than when the ledge is along the top end of the backplate and thereby more proximate to the underside of the roof.

Figure 5A:
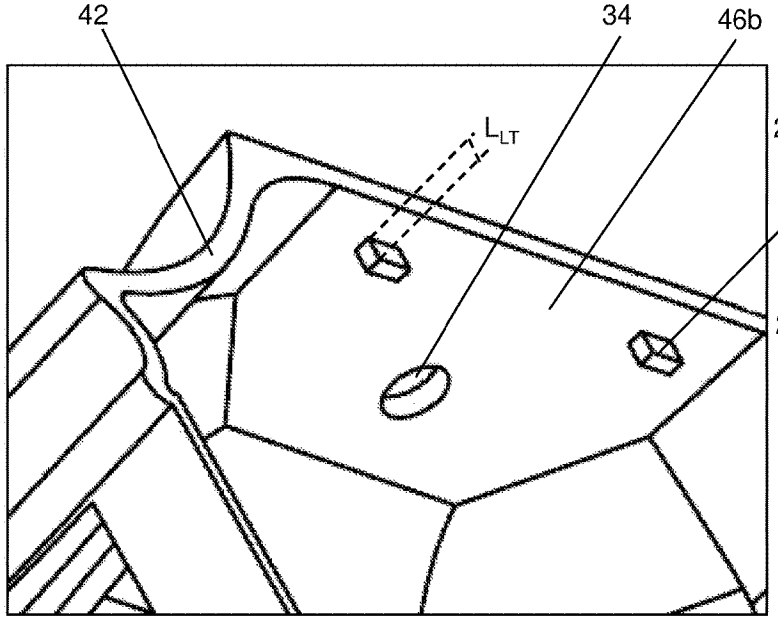
FIGS. 5A and 5B each show detail views of alternative light fixture roof configurations according to the invention described herein.
Figure 5B:
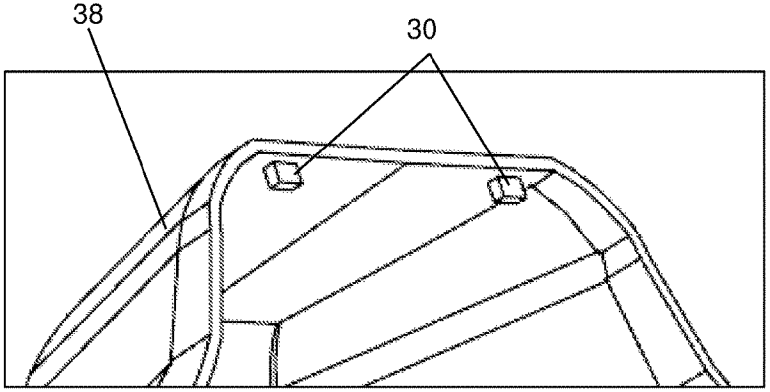

Preferably, multiple downward tabs are formed into the bottom side of the roof and respectively mate with a pair of corresponding ledge apertures in one or more ledges protruding from the backplate, as shown in FIGS. 5 and 6. However, it will be appreciated that the number of tabs may vary without departing from the invention described herein. As with the front ledge and rear ledge discussed above, the roof may only include one of the roof aperture and the downward tab in various embodiments and it is therefore not required that both the upwardly and downwardly protruding tabs are used in combination with the corresponding apertures. For example, FIG. 5B illustrates a roof having a pair of downward tabs without any roof aperture whereas FIG. 5A shows a roof embodiment with multiple downward tabs and a roof aperture for receiving an upward tab.

When an aperture is provided in the roof and an upwardly protruding tab is used to secure the cage to the backplate, with or without a downwardly protruding tab, a ledge aperture aligns with the roof aperture and the upwardly protruding tab extends through each aperture and is secured on the top side of the roof. As shown in the exploded views of FIGS. 1B and 3B, the preferred upwardly protruding tab is a releasable fastener with an externally threaded tube 82 having a tube length ($L_{UT}$) between a proximal end 60*a* and distal end 60*b*. The proximal end is secured to a mounting position on the front face of the backplate or to the lighting assembly with the length of the tube extending through the ledge and roof aperture and fastened with a mounting ring 86 on the top side of the roof. In addition, a locking nut 84*a* and an o-ring 84*b* are received on the length of the tube beneath the roof to more securely fasten the tab and create a watertight seal around the aperture.

As explained above, the upward and downward tabs are received in respective ledge apertures connected to the backplate and are sized such that the tabs mate within the respective apertures. As shown in the drawings, it is preferred that the downward protruding tabs are situated rearward of the backplate and the corresponding ledge is a rear ledge on the top end of the backplate. Conversely, a front ledge having a front ledge aperture aligns with the roof aperture and receives the upwardly protruding tab forward of the backplate. Although this configuration is preferred, it is not intended to be limiting and it will be appreciated that alternative embodiments could be provided that incorporate downwardly protruding tabs forward of the backplate. Similarly, upwardly protruding tabs may extend through a ledge aperture and a roof aperture that are rearward of the backplate. Regardless of the embodiment, the ledges and tabs need only be situated beneath the roof.

Although the upwardly protruding tab may be a simple post extending through the respective apertures that secures with a mounting ring as described above, the preferred embodiment integrates the tab with a control module 54 of the lighting assembly wherein a light sensor 56*a* is provided in the distal end of the tab above the top of the roof. In operation, the light sensor can detect a light level surrounding the light fixture to automatically turn the light assembly on and off. The light sensor in the distal end of the tab is operatively connected to a light control module at the proximal end of the tab which is subsequently connected to the lighting assembly. When the upwardly protruding tab is integrated with the lighting assembly, it is preferred that the corresponding ledge is situated forward of the backplate so that the entire lighting assembly is housed between the cage and the backplate.

Figure 2B:
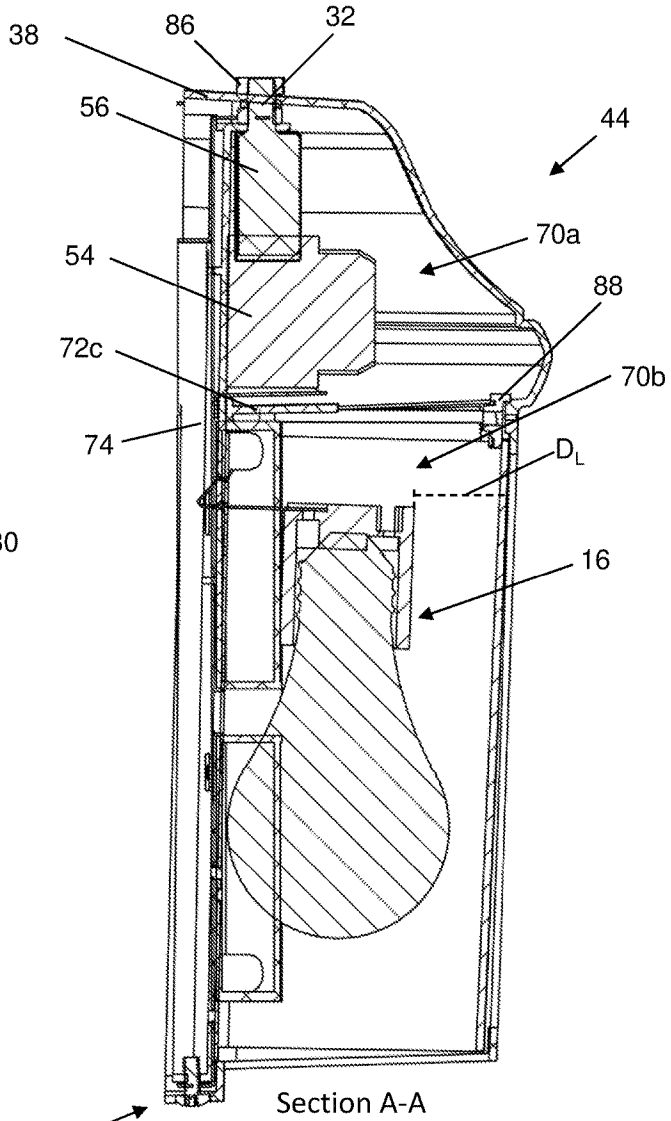
FIGS. 2A-2F respectively show a front view, a detail cross-sectional side view, a perspective view, a rear view, a top view and a bottom view of a light fixture according to the invention described herein.
Figure 2A:
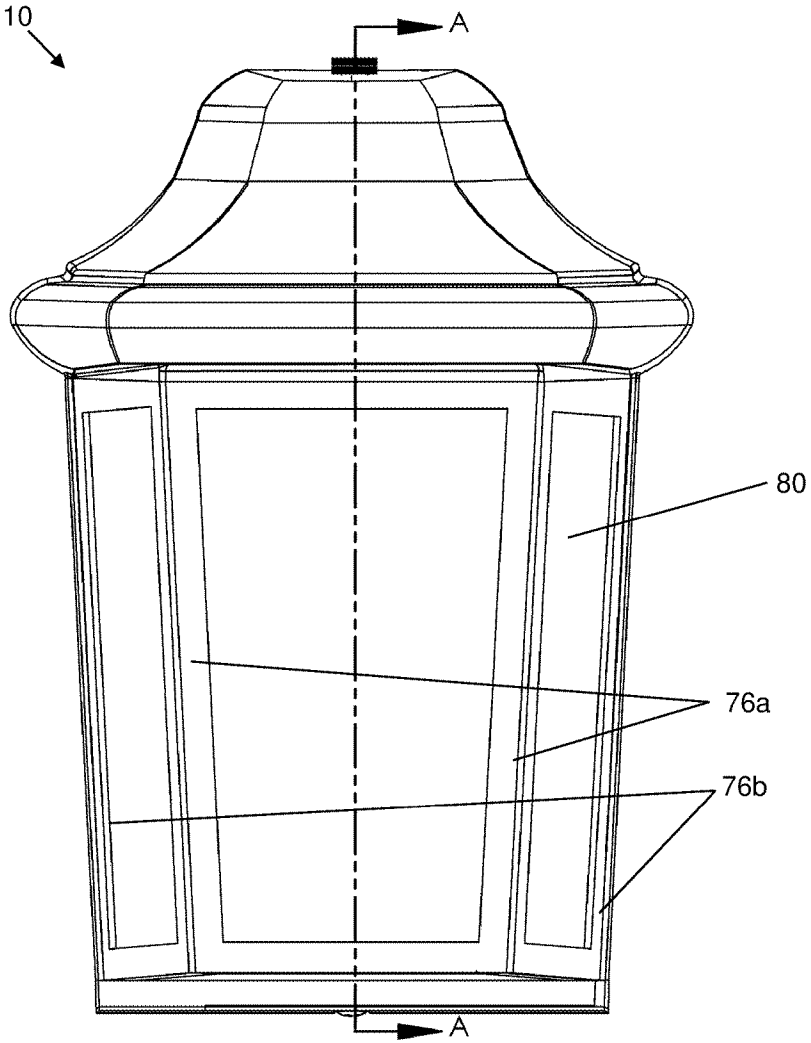
Figure 2D:
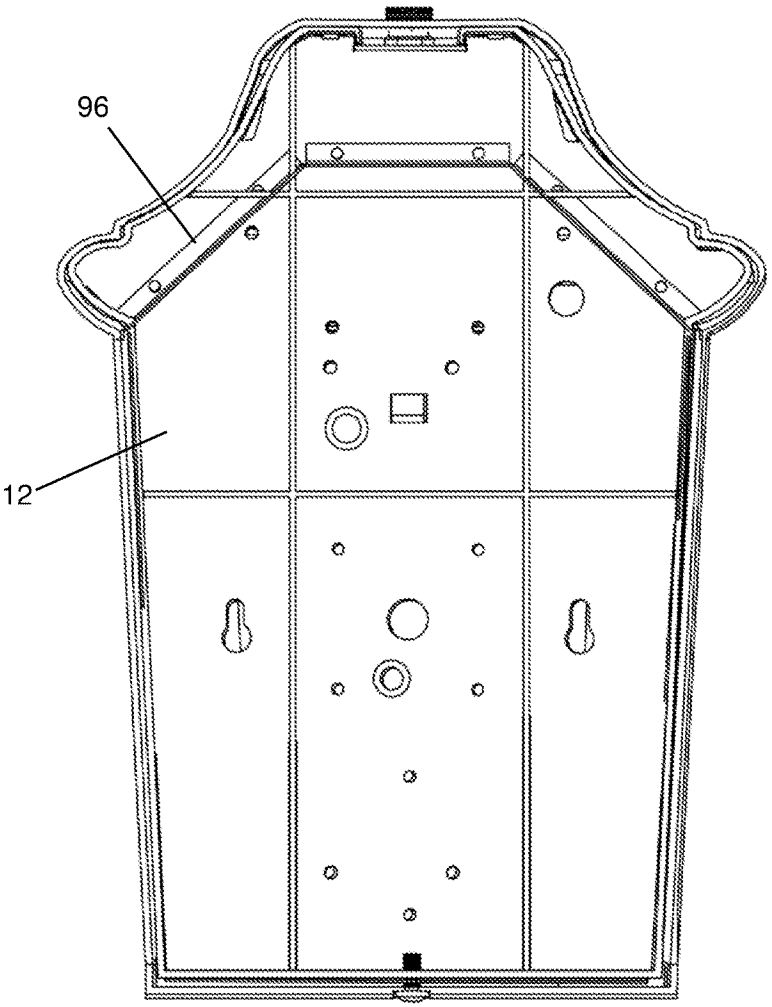
Figure 2C:
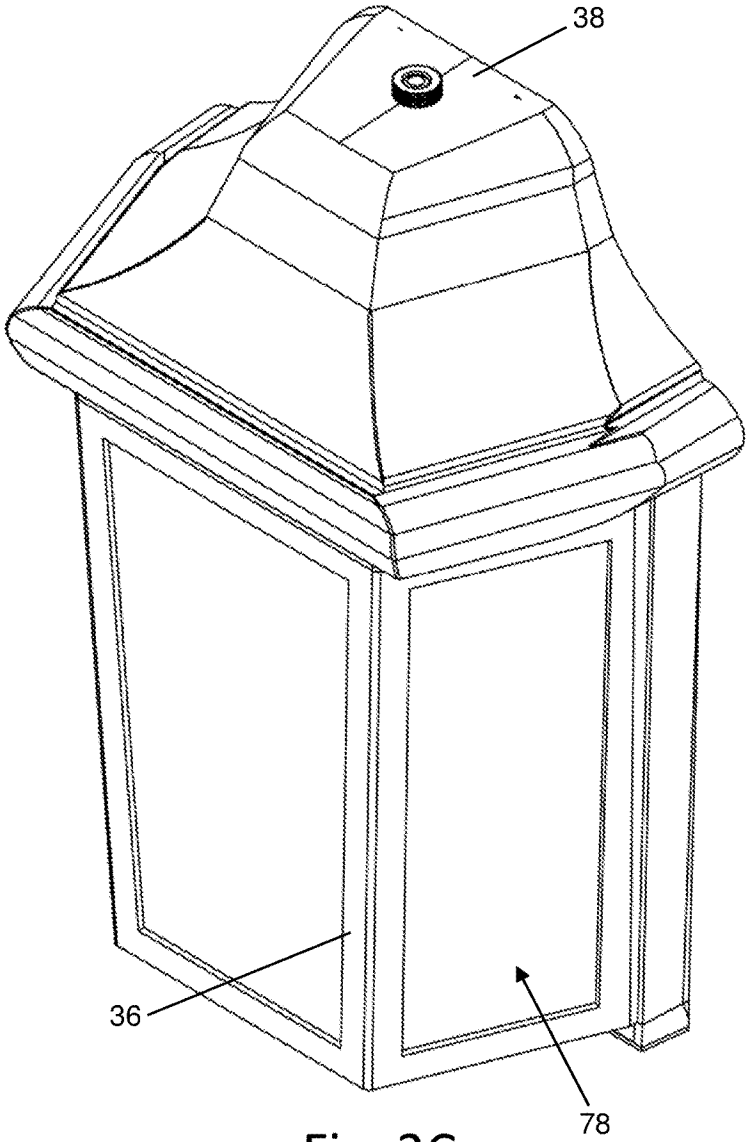
Figure 2E:
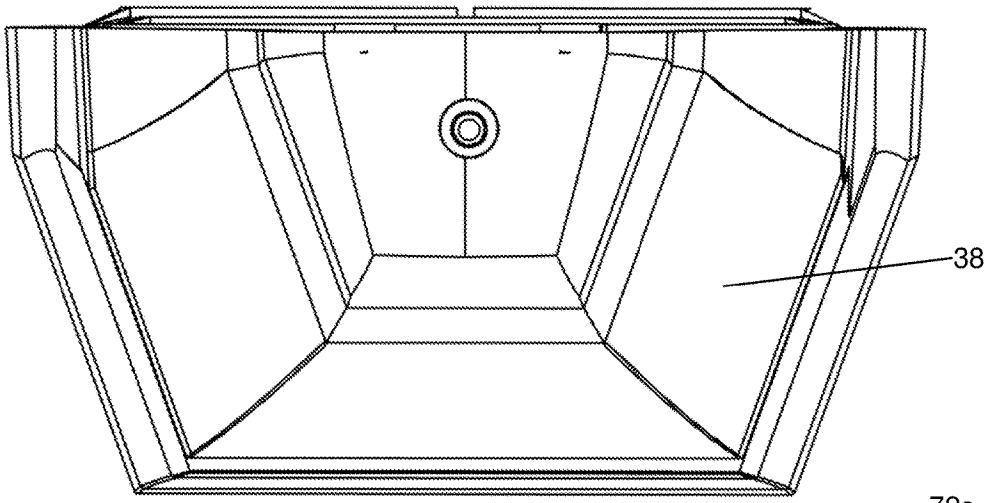
Figure 2F:
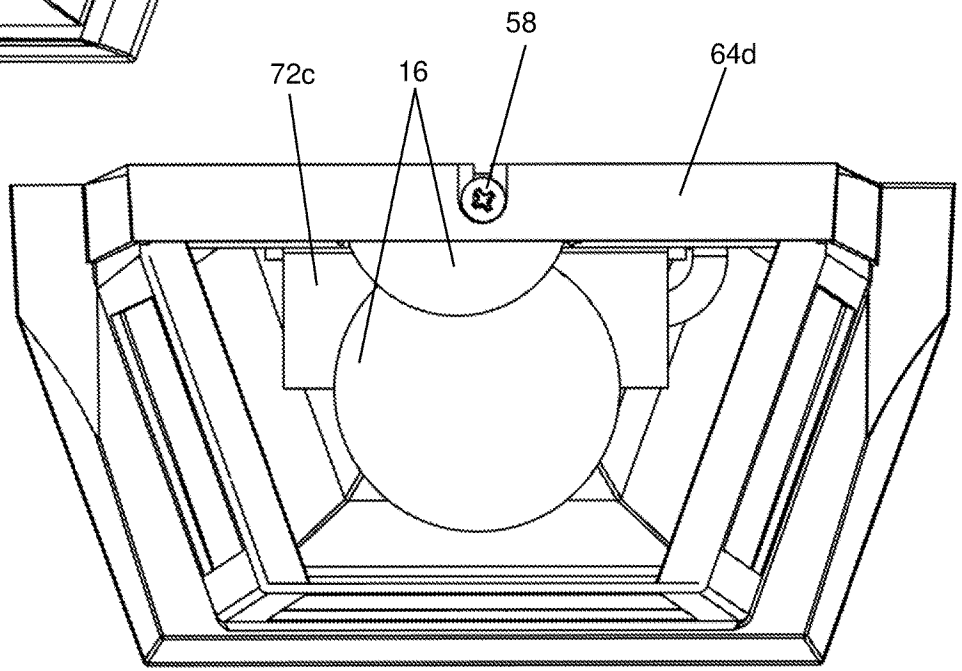
Figure 4B:
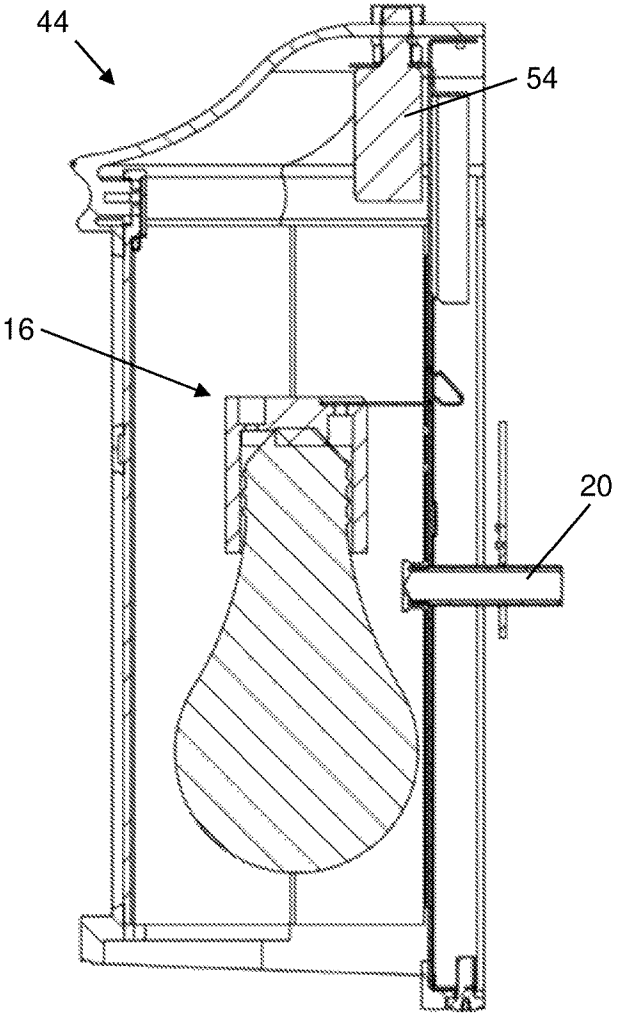
FIGS. 4A-4F respectively show a front view, cross-sectional side view, perspective view, a rear view, a top view and a bottom view of an alternative embodiment of the light fixture according to the invention described herein.
Figure 4A:
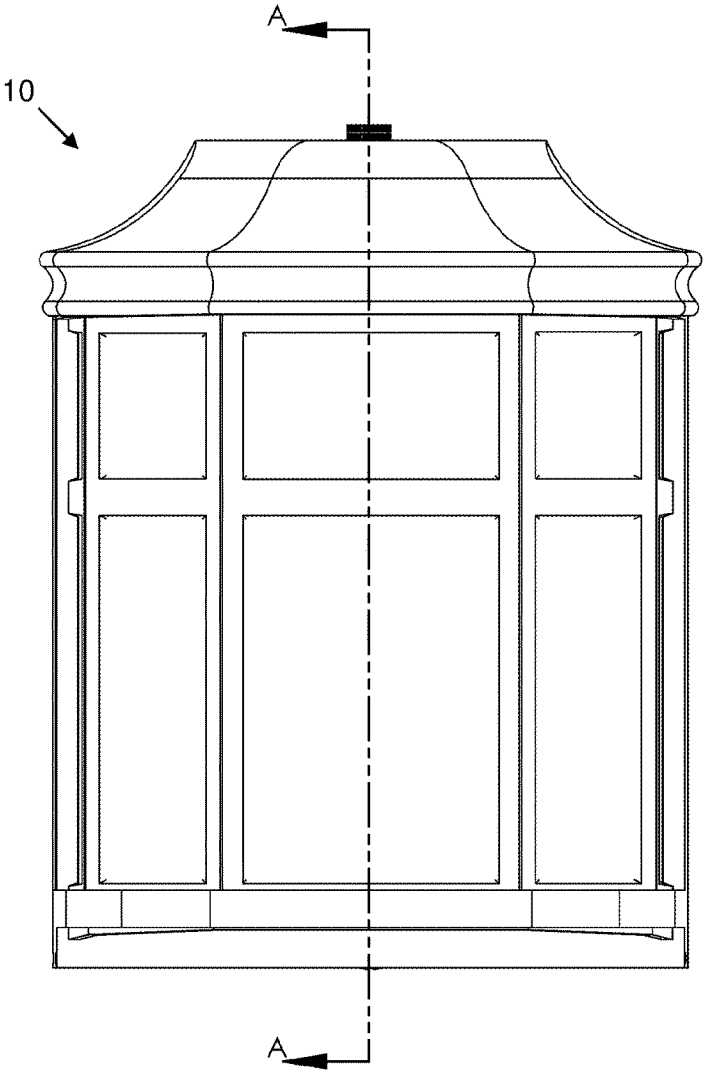
Figure 4D:
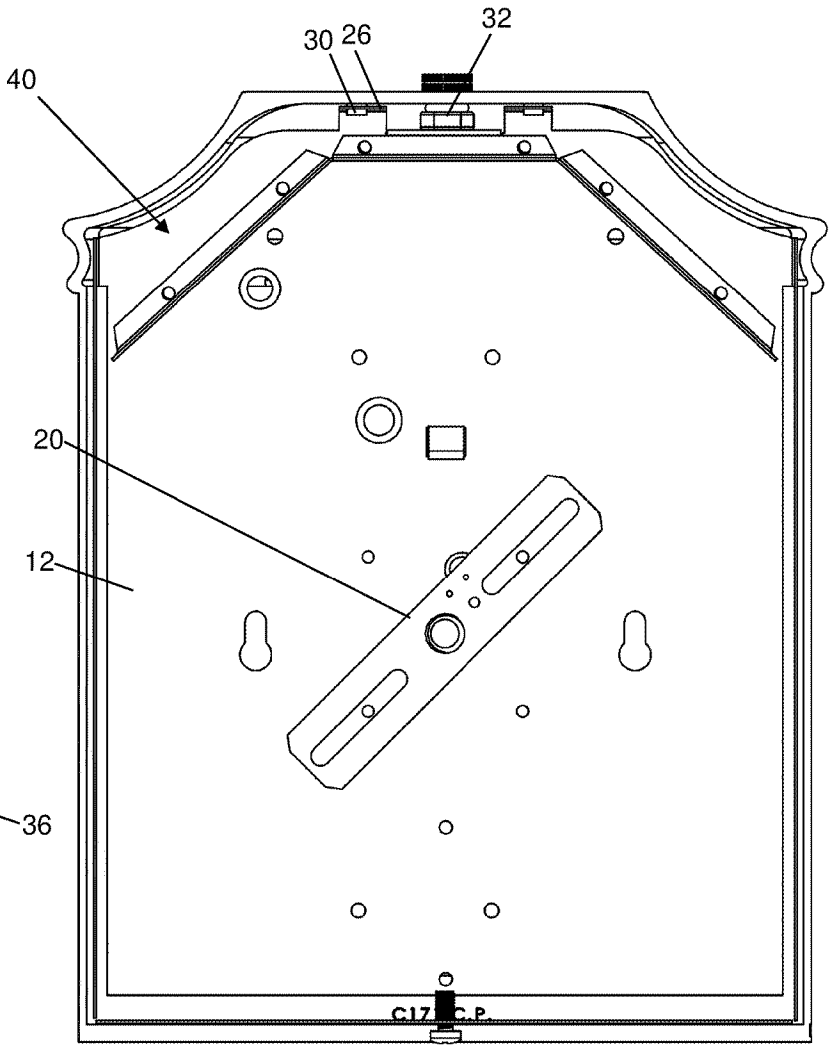
Figure 4C:
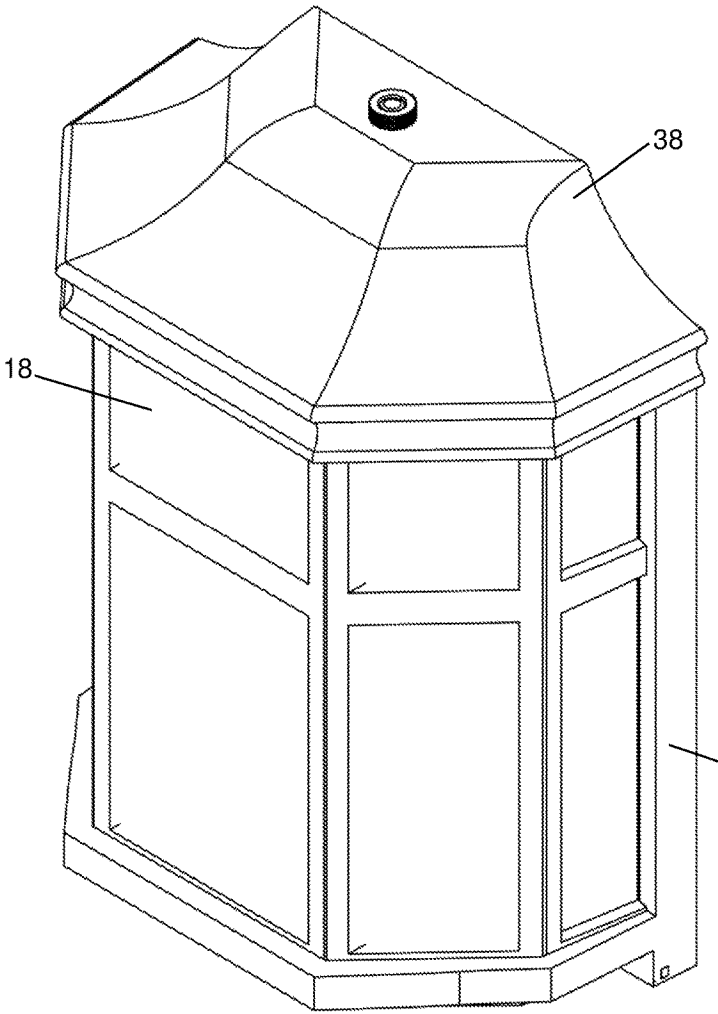
Figure 4E:
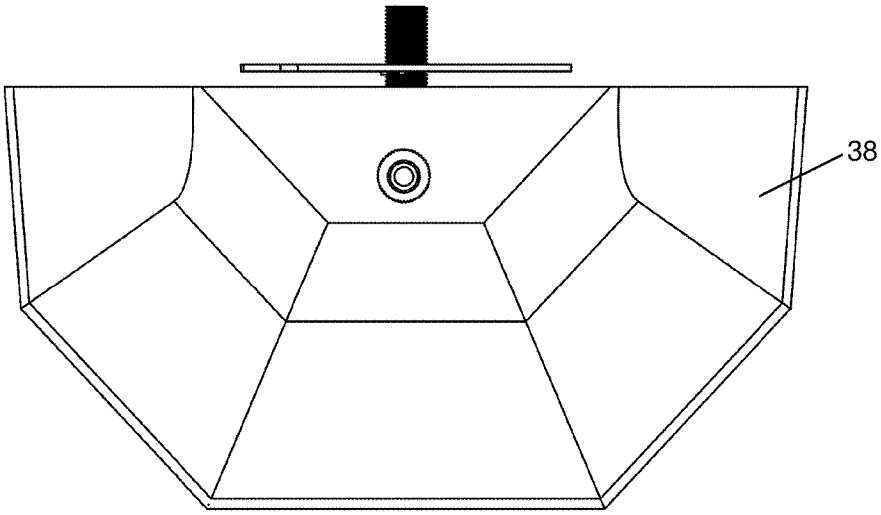
Figure 4F:
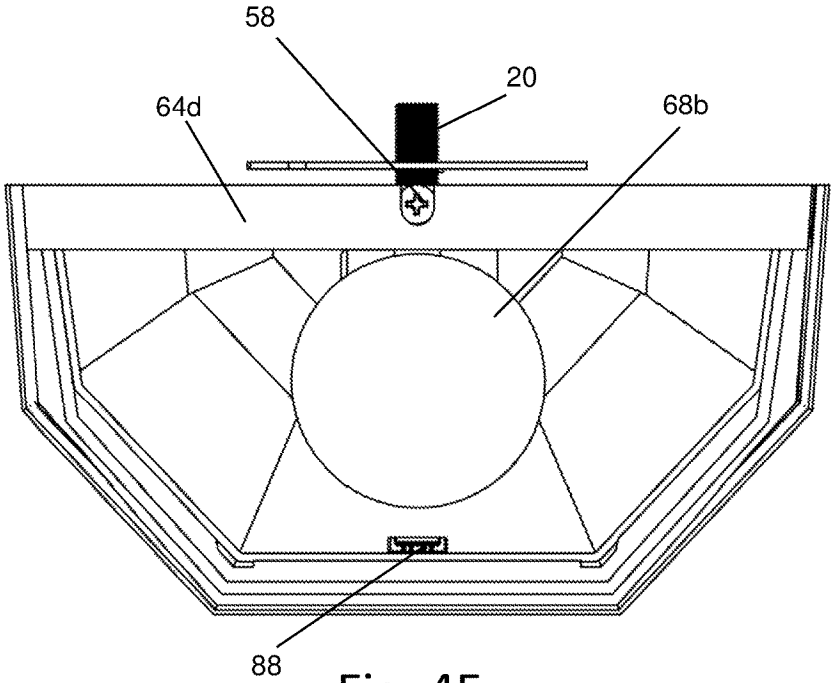

In addition to the light sensor, the control module operatively connected to the lighting assembly may also include a motion sensor control 56*b*. As shown in FIGS. 2B and 4B, the control module is connected to the front face of the backplate between the mounting bracket 48 of the lighting assembly and the top end of the backplate and automatically controls the lighting assembly when the lighting sensor or motion sensor are activated.

As indicated above, the backplate includes multiple apertures for connecting various lighting assemblies and is therefore not limited to a single lighting assembly type. Persons skilled in the art of light fixture design will appreciate that the apertures in the backplate can receive fasteners for securing the lighting assembly as well as receive the wiring used for traditional light sockets that hold different types of screw-in bulbs, such as incandescent bulbs, compact fluorescent lamps with electronic ballasts, and LED bulbs with AC-DC driver circuitry, as well as wiring bundles used with LED assemblies that do not require the traditional light socket.

Figure 3A:
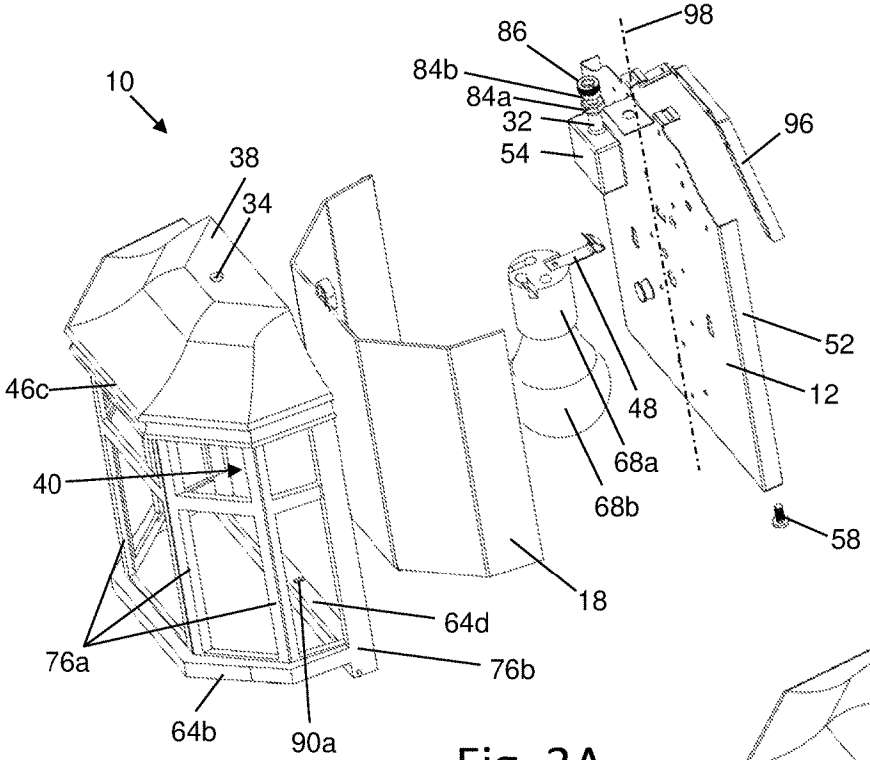

The exploded fixtures in FIGS. 1 and 3 as well as the cross-sectional view in FIG. 2B show alternative lighting fixtures that may be included in the light fixture described herein without departing from the innovative aspects. In one embodiment, the lighting assembly includes a socket assembly with a light socket 68*a* and a light bulb 68*b*. The mounting bracket is integrated with the socket and is connected to the backplate with the bulb suspended from the socket.

In an alternative embodiment, the light assembly consists of a light emitting diode assembly with an LED board 72*a* that is connected to the backplate with a heat sink panel 72*b* situated between the LED board and front face of the backplate. As shown in FIG. 2B, the heat sink panel situated between the rear of the LED and front of the backplate also includes multiple apertures that align with the apertures in the backplate so that the lighting element can be properly secured and corresponding wiring can pass from the LED to the supporting structure. In addition, a heat block 72*c* may also be provided to separate the lighting element from the control modules. The heat block extends a heat block length (LHB) from at an end that connects at a location 74 to the front face of the backplate and at least partially separates the interior volume of the cage into an upper compartment 70*a* and a lower compartment 70*b* to reduces heat dissipation from the lighting element positioned in the lower compartment from damaging the control module situated in the upper compartment between the heat block and the roof. Preferably, the heat block is longer than the forward-facing ledge and the rearward-facing ledges but as shown in the drawings does not necessarily span the entire distance between the backplate to the shade. Instead, the preferred heat block is positioned directly between the lighting element and the control module to shade the control modules from direct radiant energy produced by the lighting element.

Figure 7:
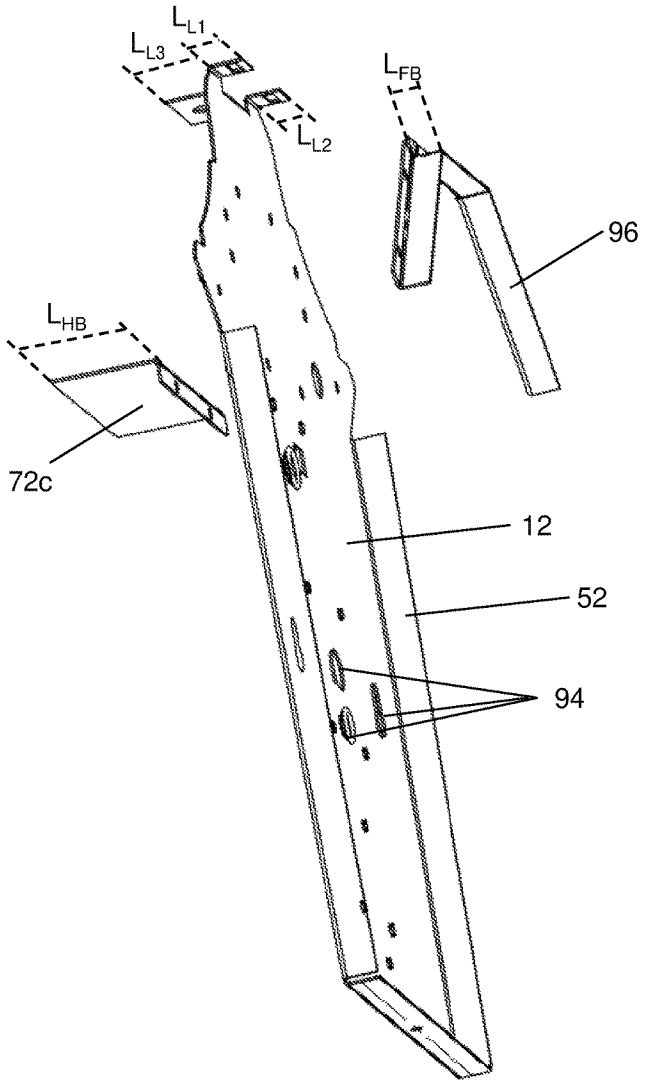
FIG. 7 shows an exploded view of an alternative backplate according to the invention described herein.

The rear face of the backplate may also include a finger block 96 proximate to the top end when no sidewalls are provided proximate to the top end of the backplate. As shown in FIG. 7, the finger block attaches proximate to the top end of the backplate and extends a plate length ($L_{FB}$) away from the back face.

Persons having a skill in the art that various materials may be used to produce the various elements described herein without departing from the innovative aspects of the light fixture including molded and pressed plastics, such as polycarbonate, and metals, such as aluminum. Furthermore, it will be appreciated that various materials may be combined within the same fixture. For example, in fixtures with an LED lighting assembly the backplate can be made from a polycarbonate material which is protected by an aluminum heat sink. Alternatively for an incandescent version, the fixture could include an aluminum backplate with a finger block on the rear of the backwall and aluminum heat block between the upper and lower compartment as discussed above.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A light fixture, comprising:

a backplate comprising a top end, a bottom end, a front face, a rear face and a first ledge protruding a ledge length proximate to the top end, wherein the first ledge is substantially perpendicular to a longitudinal axis of the backplate and comprises a first ledge aperture;

a cage comprising a frame, a roof and an open rear side, wherein the frame and the roof each comprise a rear perimeter edge collectively surrounding the open rear side, wherein the backplate is received within the open rear side in an assembled configuration, wherein the roof is further comprised of a top side, a bottom side, a front periphery and a roof aperture, wherein the first ledge aperture is aligned with the roof aperture, and wherein an upwardly facing tab is received in the first ledge aperture and the roof aperture secured above the top side of the roof; and a lighting assembly comprising a mounting bracket connected to the front face of the backplate beneath the top end, and wherein the lighting assembly is enveloped by the cage.

2. The light fixture of claim 1, wherein the first ledge the ledge length rearward from the rear face of the backplate, and wherein the backplate further comprises a pair of sidewalls extending rearward from a corresponding pair of backplate side ends a sidewall distance approximately equal to the ledge length.

3. The light fixture of claim 2, further comprising a light sensor of a light control module operatively connected to the lighting assembly, a locking screw and a third ledge comprising a third aperture, wherein the third ledge extends a third ledge length forward from the front face of the backplate, wherein the third ledge length is greater than the ledge length, wherein the roof aperture is aligned with the third ledge aperture for receiving the upwardly facing tab, wherein the light sensor is situated within a distal end of the upwardly facing tab secured above the top side of the roof, wherein the light control module is connected to a proximal end of the upwardly facing tab beneath the third ledge, wherein the backplate further comprises a bottom flange extending rearward from the bottom end a flange distance approximately equal to the ledge length, wherein a lower rear rail of the frame and the bottom flange each further comprise a locking screw aperture aligned with one another in the assembled configuration, and wherein the locking screw is received within the locking screw apertures in a locked arrangement.

4. The light fixture of claim 1, wherein the lighting assembly further comprises a light socket and a light bulb, wherein the light socket is fixedly connected to the mounting bracket, and wherein the light bulb is suspended from the light socket.

5. The light fixture of claim 1, wherein the lighting assembly further comprises a light emitting diode assembly comprising an LED board and at least one of a heat block and a heat sink panel, wherein the heat block extends forward from the front face of the backplate by a distance greater than the ledge length at a location between the top end of the backplate and the mounting bracket of lighting assembly, and wherein the heat sink panel is situated on the front face of the backplate.

6. The light fixture of claim 1, further comprising a control module comprising at least one of a motion sensor control and a light sensor control, wherein the control module is connected to the front face of the backplate between the mounting bracket and the top edge of the backplate, and wherein the control module operatively controls the lighting assembly.

7. The light fixture of claim 1, wherein the frame is comprised of an upper collar, a lower collar, a lower rear rail, and a plurality of side rails, wherein the side rails connect the upper collar to the lower collar, and wherein the lower rear rail connects opposite sides of the lower collar.

8. The light fixture of claim 7, further comprising a lens, wherein the lens is held within the frame by the side rails and the lower rear rail, wherein the side rails are further comprised of at least one front side rail and at least a pair of rear side rails, wherein the lens is a single-piece shell formed in at least one of a prismatic shape and a cylindrical shape, wherein the lens is positioned at a distance around the lighting assembly, and wherein an outer surface of the lens contacts an inner surface of the side rails.

9. The light fixture of claim 1, further comprising a wall mount assembly fixedly connected to the rear face of the wall panel.

10. The light fixture of claim 1, further comprising a second ledge, a second aperture in the second ledge and a downward protruding tab, wherein the downwards protruding tab protrudes from the bottom side of the roof and is received in the second aperture, wherein the first ledge extends forward from the backplate, wherein the second ledge extends rearward from the rear face of the backplate, wherein the upwardly protruding tab is further comprised of an externally threaded tube extending a tube length through the first ledge aperture and the roof aperture between a proximal end and a distal end, wherein a locking nut and an o-ring are received on the tube between the first ledge and the bottom side of the roof, and wherein a mounting ring threadingly engages the distal end of the tube to secure the upwardly facing tab above the top side of the roof.

11. The light fixture of claim 10, wherein the distal end of the tube is further comprised of a light sensor of a light control module operatively connected to the lighting assembly, wherein the light control module is connected to the proximal end of the tube beneath the first ledge and operatively connects to the light sensor through the externally threaded tube, and wherein the backplate further comprises a bottom flange extending rearward from the bottom end, and a pair of sidewalls extending rearward from a corresponding pair of side ends.

12. A light fixture, comprising:

a backplate comprising a top end, a bottom end, a front face, a rear face and a first ledge extending a first ledge length rearward from the rear face of the backplate proximate to the top end, and wherein the first ledge is substantially perpendicular to a longitudinal axis of the backplate and comprises a first ledge aperture;

a cage comprising a frame, a roof and an open rear side, wherein the frame and the roof each comprise a rear perimeter edge collectively surrounding the open rear side, wherein the backplate is received within the open rear side in an assembled configuration, wherein the roof is further comprised of a top side, a bottom side, a front periphery and a cage support tab protruding a tab length from the bottom side of the roof proximate to the rear perimeter edge, and wherein the first ledge aperture is aligned with and receives the cage support tab; and a lighting assembly comprising a mounting bracket connected to the front face of the backplate beneath the top end, and wherein the lighting assembly is enveloped by the cage.

13. The light fixture of claim 12, wherein the backplate further comprises a second ledge extending a second ledge length forward from the front face of the backplate, wherein the second ledge further comprises a second ledge aperture, and wherein the roof further comprises a roof aperture aligned with the second ledge aperture for receiving an upwardly facing tab secured above the top side of the roof.

14. The light fixture of claim 13, wherein the upwardly protruding tab is further comprised of an externally threaded tube extending a tube length through the second ledge aperture and the roof aperture between a proximal end and a distal end, wherein a locking nut and an o-ring are received on the tube between the second ledge and the bottom side of the roof, wherein a mounting ring threadingly engages the distal end of the tube to secure the upwardly facing tab above the top side of the roof, wherein the distal end of the tube is further comprised of a light sensor of a light control module operatively connected to the lighting assembly, wherein the light control module is connected to the proximal end of the tube beneath the first ledge and operatively connects to the light sensor through the externally threaded tube.

15. The light fixture of claim 12, wherein the frame is further comprised of an upper collar, a lower collar, a lower rear rail, and a plurality of side rails, wherein the side rails connect the upper collar to the lower collar, wherein the lower rear rail connects opposite sides of the lower collar, wherein the backplate is further comprised of a pair of sidewalls extending rearward from a corresponding pair of backplate side ends by a sidewall distance and a bottom flange extending rearward from the bottom end a flange distance, wherein the sidewall distance and the flange distance are approximately equal to the ledge length, wherein the lower rear rail of the frame and the bottom flange each further comprise a locking screw aperture aligned with one another in the assembled configuration, and wherein a locking screw is received within the locking screw apertures in a locked arrangement.

16. The light fixture of claim 12, wherein the lighting assembly further comprises at least one of a light socket assembly and a light emitting diode assembly, wherein the light socket assembly comprises a light socket and a light bulb, wherein the light socket is fixedly connected to the mounting bracket, wherein the light bulb is suspended from the light socket, wherein the light emitting diode assembly comprises an LED board and at least one of a heat block and a heat sink panel, wherein the heat block extends forward from the front face of the backplate by a distance greater than the ledge length at a location between the top end of the backplate and the mounting bracket of lighting assembly, and wherein the heat sink panel is situated on the front face of the backplate.

17. A light fixture, comprising a backplate comprising a top end, a bottom end, a front face, a rear face, a pair of sidewalls extending rearward from a corresponding pair of backplate side ends by a sidewall distance, a bottom flange extending rearward from the bottom end a flange distance, a first ledge, a second ledge and a third ledge respectively having a first ledge aperture, a second ledge aperture and a third ledge aperture, wherein the first ledge and the second ledge extend a ledge length rearward from the rear face of the backplate proximate to the top end, wherein the sidewall distance and the flange distance are approximately equal to the ledge length, wherein the third ledge extends a third ledge length forward from the front face of the backplate beneath the top end, and wherein the first ledge, the second ledge and the third ledge are substantially perpendicular to a longitudinal axis of the backplate;

a cage comprising a frame, a roof and an open rear side, wherein the frame and the roof each comprise a rear perimeter edge collectively surrounding the open rear side, wherein the backplate is received within the open rear side in an assembled configuration, wherein the frame further comprises an upper collar, a lower collar, a lower rear rail, and a plurality of side rails, wherein the side rails connect the upper collar to the lower collar, wherein the lower rear rail connects opposite sides of the lower collar, wherein the roof is further comprised of a top side, a bottom side, a front periphery, a pair of downward extending cage supports and a roof aperture, wherein the first ledge aperture and the second ledge aperture respectively align with and receive the pair of downward extending cage supports, wherein the roof aperture is aligned with the third ledge aperture for receiving an upwardly facing tab secured above the top side of the roof, wherein the lower rear rail of the frame and the bottom flange each further comprise a locking screw aperture aligned with one another in the assembled configuration, and wherein a locking screw is received within the locking screw apertures in a locked arrangement;

a lighting assembly comprising a mounting bracket connected to the front face of the backplate beneath the top end, and wherein the lighting assembly is enveloped by the cage; and a control module operatively controlling the lighting assembly, wherein the control module comprises at least one of a motion sensor control and a light sensor control, and wherein the control module is connected to the front face of the backplate between the mounting bracket and the top edge of the backplate.

18. The light fixture of claim 17, wherein the upwardly protruding tab further comprises an externally threaded tube extending a tube length through the third ledge aperture and the roof aperture between a proximal end connected to the control module and a distal end secured above the top side of the roof, wherein the control module further comprises a light sensor situated within the distal end of the upwardly facing tab secured above the top side of the roof, wherein a locking nut and an o-ring are received on the tube between the front ledge and the bottom side of the roof, and wherein a mounting ring threadingly engages the distal end of the tube to secure the upwardly facing tab above the top side of the roof.

19. The light fixture of claim 17, further comprising a lens, wherein the lens is held within the frame by the side rails and the lower rear rail, wherein the side rails are further comprised of at least one front side rail and at least a pair of rear side rails, wherein the lens is a single-piece shell formed in at least one of a prismatic shape and a cylindrical shape, wherein the lens is positioned at a distance around the lighting assembly, and wherein an outer surface of the lens contacts an inner surface of the side rails.

20. The light fixture of claim 17, wherein the lighting assembly further comprises at least one of a light socket assembly and a light emitting diode assembly, wherein the light socket assembly comprises a light socket and a light bulb, wherein the light socket is fixedly connected to the mounting bracket, wherein the light bulb is suspended from the light socket, wherein the light emitting diode assembly comprises an LED board and at least one of a heat block and a heat sink panel, wherein the heat block extends forward from the front face of the backplate by a distance greater than the ledge length at a location between the top end of the backplate and the mounting bracket of lighting assembly, and wherein the heat sink panel is situated on the front face of the backplate.

21. A light fixture, comprising:

a backplate comprising a top end, a bottom end, a front face, a rear face and a first ledge protruding a ledge length proximate to the top end, wherein the first ledge is substantially perpendicular to a longitudinal axis of the backplate and comprises a first ledge aperture;

a cage comprising a frame, a roof and an open rear side, wherein the frame and the roof each comprise a rear perimeter edge collectively surrounding the open rear side, wherein the backplate is received within the open rear side in an assembled configuration, wherein the roof is further comprised of a top side, a bottom side, a front periphery and a downward extending tab, wherein the first ledge aperture is aligned with the downward extending tab, and wherein the downward extending tab is received in the first ledge aperture when aligned therewith; and a lighting assembly comprising a mounting bracket connected to the front face of the backplate beneath the top end, and wherein the lighting assembly is enveloped by the cage.

22. The light fixture of claim 21, wherein the roof further comprises a roof aperture, and wherein an upwardly facing tab is received in the roof aperture and secured above the top side of the roof in the assembled configuration.

* * * * *